343-756
2/19/80 XR 4,189,731

United States Patent [19]
Rope et al.
[11] 4,189,731
[45] Feb. 19, 1980

[54] RADOME WITH TILTED DIELECTRIC STRIPS

[75] Inventors: Eugene L. Rope, El Cajon; Gus P. Tricoles, San Diego, both of Calif.

[73] Assignee: General Dynamics Electronics Division, San Diego, Calif.

[21] Appl. No.: 914,519

[22] Filed: Jun. 12, 1978

[51] Int. Cl.² ..... H01Q 1/42
[52] U.S. Cl. ..... 343/872; 343/756
[58] Field of Search ..... 343/872, 909, 911, 756

[56] References Cited

U.S. PATENT DOCUMENTS

| | | | |
|---|---|---|---|
| 3,063,654 | 11/1962 | Youngren et al. | 343/872 |
| 3,576,581 | 4/1971 | Tricoles et al. | 343/872 |
| 3,780,374 | 12/1973 | Shibano et al. | 343/872 |

OTHER PUBLICATIONS

Bodnar et al. "Analysis of an Anisotropic Dielectric Radome," IEEE Transactions on Antennas and Propagation, Nov. 1975, pp. 841–846.

*Primary Examiner*—David K. Moore
*Attorney, Agent, or Firm*—Brown & Martin

[57] ABSTRACT

A radome having arrays of thin strips of dielectric material on both the inside and outside walls of a conical shell defined by a sheet of dielectric material for compensating for the polarization dependent phase delay of the radome shell is disclosed. The strips of the outside array are supported edgewise on the outside wall and are normal thereto. The outside strips are equally spaced from each other, and disposed so that the intersection of lines extending therefrom is at the vertex of the shell. The strips of the inside array are supported edgewise on the inside strips wall. The inside strips are spaced from one another and tilted from the inside wall at an angle of approximately 45 degrees in a direction away from the vertex of the shell. Each of the inside strips is a frustum of a cone disposed with its axis along the axis of the shell. The tilt of the inside strips increases the transmittance bandwidth of the radome and further decreases dependence of phase delay upon the angle of incidence.

12 Claims, 5 Drawing Figures

RADOME WITH TILTED DIELECTRIC STRIPS

BACKGROUND OF THE INVENTION

The present invention is generally directed to radomes and is particularly directed to improving the transmittance bandwidth of radomes having thin dielectric strips on a wall of the radome for compensating for the polarization dependent phase delay of the radome.

A radome is a housing that protects a radar antenna from the elements and does not block radio frequencies. A radome typically includes a dielectric material sheet defining a shell. For radomes installed on the nose of a missile or aircraft, the shell is conical or ogival in shape. The term "conical", as used herein, refers to both conical and ogival shapes. The typical radome shell has a nearly constant thickness that is chosen for transmittance bandwidth and that varies slightly to reduce boresight error.

U.S. Pat. No. 3,576,581, issued Apr. 27, 1971 to the inventors herein, describes a radome having a dielectric material sheet defining a conical shell having an array of thin dielectric material strips supported edgewise on the inside wall of the sheet with the edges of the strips being in contact with the sheet. The array of strips provides anisotropy favoring either parallel or perpendicular polarization components of incident radiation, and thereby compensates the polarization dependent phase delay of the radome shell to reduce sidelobe levels and boresight error while increasing power transmittance. Two alternative preferred embodiments of the arrays of strips are described in U.S. Pat. No. 3,576,581. In one such embodiment, the strips are equally spaced from each other, and disposed so that the intersection of lines extending therefrom is at the vertex of the shell, thereby providing anisotropy favoring parallel polarization components of incident radiation. In the alternative embodiment, the strips are circular rings having their axes along the axis of the shell, thereby providing anisotropy favoring perpendicular components of incident radiation.

It is an object of the present invention to increase the transmittance bandwidth of radomes including such strips.

SUMMARY OF THE INVENTION

The present invention is a radome including a dielectric material sheet defining a shell having inside and outside walls; a first array of thin strips of dielectric material supported on one wall of the shell; and a second array of tilted thin strips of dielectric material supported on the other wall of the shell.

The dielectric material sheet may be either approximately planar or it may define a symmetrically curved shell having a vertex and a given axis.

The term "given axis" is defined as follows with respect to different shapes of symmetrically curved shell. When the symmetrically curved shell defines a surface of revolution, the given axis is the axis of symmetry. When the symmetrically curved shell does not define a surface of revolution, but rather is symmetrical about a plane of symmetry, the given axis is an axis in the plane of symmetry that is approximately centered with respect to the surfaces of the shell intersected by the plane of symmetry.

In the embodiments of the radome wherein the dielectric material sheet defines a symmetrically curved shell having a vertex and a given axis, the first array of thin strips of dielectric material are supported edgewise on one wall of the shell, with the supported edges of the strips being spaced from each other and disposed in radial planes that include the given axis, and with each strip being normal to the one wall, for providing anisotropy favoring parallel polarization components of incident radiation; and the second array of thin strips of dielectric material are supported edgewise on the other wall of the shell, with the supported edges of the strips being spaced from one another and disposed perpendicular to the supported edges of the strips in the first array, and with all of the strips being tilted from the other wall at an acute angle in a common direction away from the vertex for providing anisotropy favoring perpendicular polarization components of incident radiation. Preferably, each of the strips of the second array is tilted from the other wall at an angle of approximately 45 degrees.

In the embodiment of the radome wherein the dielectric material sheet is approximately planar, the strips of the first array are supported edgewise on one wall of the sheet, are spaced from each other, and are disposed parallel to each other, with each strip being normal to the one wall, for providing anisotropy favoring parallel polarization components of incident radiation; and the strips of the second array are supported edgewise on the other wall of the sheet, and from one another, and are disposed with their supported edges perpendicular to the supported edges of the strips in the first array, with all of the strips being tilted from the other wall at an acute angle in a common direction for providing anisotropy favoring perpendicular polarization components of incident radiation. Again the preferred angle of tilt is approximately 45 degrees.

The radome of the present invention provides increased transmittance bandwidth over the prior art radome discussed hereinabove, and further decreases dependence of phase delay upon the angle of incidence.

DESCRIPTION OF THE PREFERRED EMBODIMENTS

Figure 1:
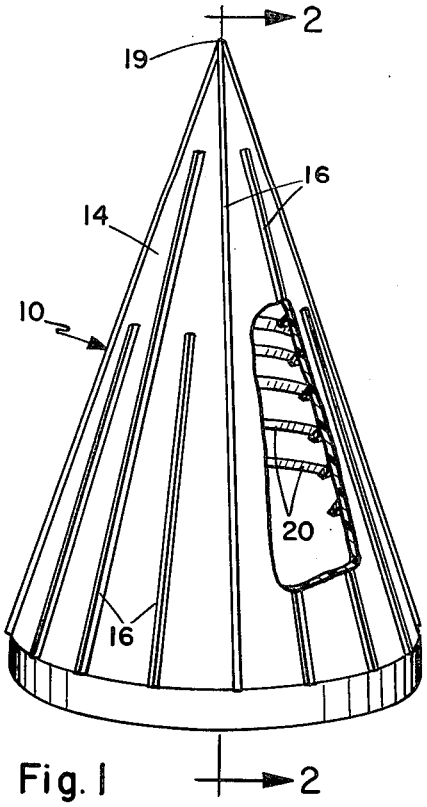
FIG. 1 is a perspective view of a preferred embodiment of a radome of the present invention with a portion of the shell cut away to show the interior of the radome.
Figure 2:
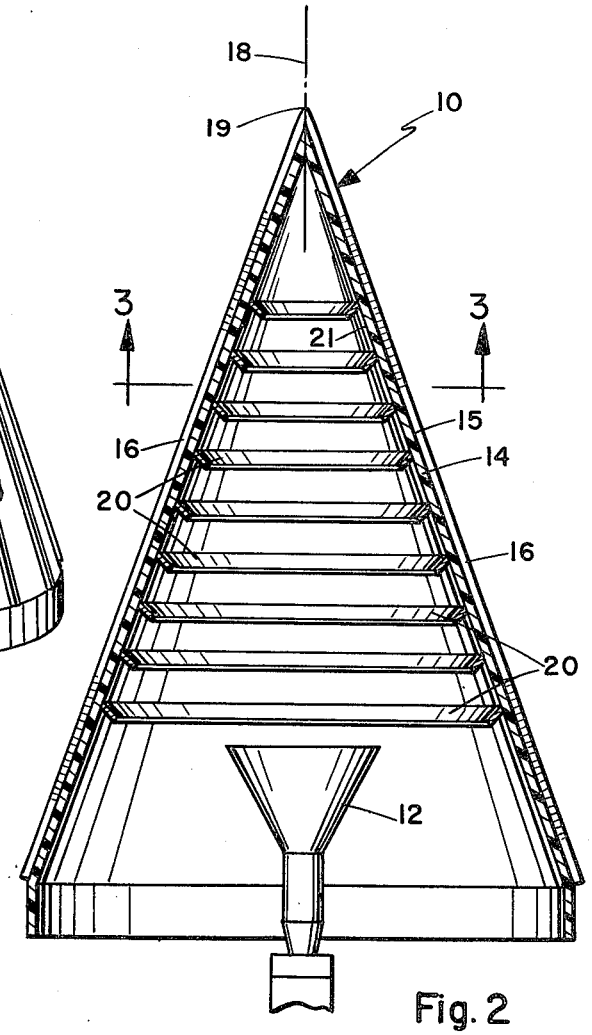
FIG. 2 is a sectional view of the radome taken along line 2—2 of FIG. 1.
Figure 3:
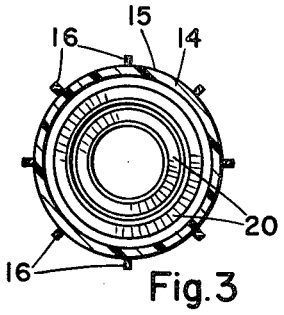
FIG. 3 is a sectional view of the radome taken along line 3—3 of FIG. 2.

Referring to FIGS. 1, 2 and 3, a radome 10 provides a protective cover for an antenna 12. The radome 10 includes a sheet of dielectric material defining a conical shell 14. Although the axially-symmetric shell 14 is shown as a cone in the Drawing, the shell may be ogival or some other symmetrically curved shaped in other preferred embodiments (not shown) within the scope of the present invention.

A first array of thin strips 16 of dielectric material is supported edgewise on the outside wall 15 of the shell 14 and in contact therewith. The strips 16 are disposed along the axis 18 of the shell 14, equally spaced from each other, and directed so that the intersection of lines extending therefrom is at the vertex 19 of the shell 14. Each strip 16 is normal to the surface of the shell 14 at the position of contact therewith. Preferably, the thin strips 16 have a rectangular cross-section. However, the thin strips on the outside of the radome 10 may have a wedge-shaped cross-section, with the wedge pointing away from the outside wall of the shell 14; in which case it is the plane that is approximately centered with respect to the wedge-shaped surfaces that is normal to the surface of the shell at the position of contact.

A second array of thin strips 20 of dielectric material are supported edgewise on the inside wall 21, of the shell 14 and in contact therewith. Each of the strips 20 is a frustum of a cone disposed with its axis along the axis 18 of the shell 14, and directed away from the vertex 19 of the shell 14.

Each thin strip 20 preferably has a rectangular cross-section and is tilted at an angle of approximately 45 degrees to the inside wall 21 of the shell 14 at the position of contact therewith. However, the thin strips on the inside of the radome 10 also may have a wedge-shaped cross-section with the wedge pointing away from the inside wall of the shell 14, in which case it is the plane that is approximately centered with respect to the wedge shaped surfaces that is tilted at an angle of approximately 45 degrees to the inside wall of the shell at the position of contact.

The spacing between the thin strips 20, and the structural features of the radome 10 not otherwise described herein, are in accordance with the teachings of the aforementioned U.S. Pat. No. 3,576,581, the disclosure of which is incorporated herein by reference thereto.

Figure 4:
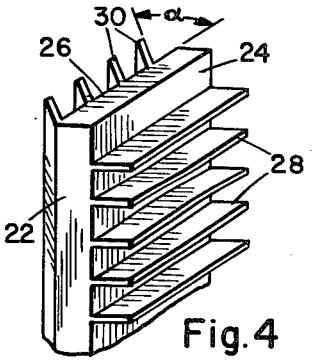
FIG. 4 is a perspective view of a cut-away portion of a radome according to the present invention wherein the dielectric material sheet is approximately planar.

FIG. 4 illustrates the positioning of the thin strips of dielectric material on a radome having an approximately planar dielectric material sheet. The sheet 22 has an inside wall 24 and an outside wall 26.

A first array of thin strips 28 of dielectric material are supported edgewise on the inside wall 24. The strips 28 are spaced from each other and disposed parallel to each other, with each strip 28 being normal to the inside wall 24, for providing anisotropy favoring parallel polarization components of incident radiation.

Figure 5:
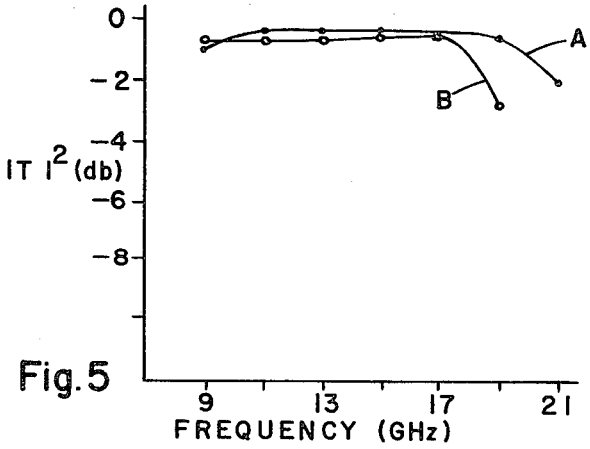
FIG. 5 is a graph showing the transmittance-frequency characteristic of the radome of the present invention with tilted strips and the transmittance-frequency characteristic of a radome wherein the strips on both sides of the radome are orthogonal to the surface thereof, for a radiation incidence angle of 60 degrees.

A second array of thin strips 30 of dielectric material are supported edgewise on the outside wall 26. The supported edges of the strips 30 being spaced from one another and disposed perpendicular to the supported edges of the strips 28 in the first array, and with all the strips 30 being tilted from the outside wall at an acute angle of approximately 45 degrees in a common direction for providing anisotropy favoring perpendicular polarization components of incident radiation. The effect of tilting the strips on one side of the radome wall is shown in FIG. 5. Curve A shows the transmittance-frequency characteristic for a radome having strips on one side of the radome shell tilted at 45 degrees and the strips on the other side of the shell orthogonal to the surface thereof in accordance with the present invention for a radiation incidence angle of 60 degrees, a typical incidence angle for missile and aircraft applications. Curve A is seen to have a greater transmittance bandwidth than Curve B, which shows the transmittance-frequency characteristic for a radome having strips on both sides of the radome shell orthogonal to the surface thereof, also at a radiation incidence angle of 60 degrees.

We claim:

1. A radome comprising:

a dielectric material sheet defining a symmetrically curved shell having a vertex and a given axis, and having inside and outside walls;

a first array of thin strips of dielectric material supported edgewise on one wall of the shell, with the supported edges of the strips being spaced from each other and disposed in radial planes that include the given axis, and with each strip being normal to the one wall, for providing anisotropy favoring parallel polarization components of incident radiation; and a second array of thin strips of dielectric material supported edgewise on the other wall of the shell, with the supported edges of the strips being spaced from one another and disposed perpendicular to the supported edges of the strips in the first array, and with all of the strips being tilted from the other wall at an acute angle in a common direction away from the vertex for providing anisotropy favoring perpendicular polarization components of incident radiation.

2. A radome according to claim 1, wherein the shell is conical and the strips of the first array are equally spaced from each other and disposed so that the intersection of lines extending therefrom is at the vertex of the shell.

3. A radome according to claim 2, wherein the strips of the first array are disposed on the outside wall.

4. A radome according to claim 1, wherein the shell is conical and each of the strips of the second array is a frustum of a cone disposed with its axis along the axis of the shell and directed away from the vertex of the shell.

5. A radome according to claim 4 wherein each of the strips of the second array is tilted from the other wall at an angle of approximately 45 degrees.

6. A radome according to claim 5 wherein the strips of the second array are disposed on the inside wall.

7. A radome according to claim 4, wherein the strips of the first array are equally spaced from each other and disposed so that the intersection of lines extending therefrom is at the vertex of the shell.

8. A radome according to claim 7, wherein each of the strips of the second array is tilted from the other wall at an angle of approximately 45 degrees.

9. A radome according to claim 8, wherein the strips of the first array are disposed on the outside wall.

10. A radome according to claim 1, wherein each of the strips of the second array is tilted from the other wall at an angle of approximately 45 degrees.

11. A radome comprising:

an approximately planar dielectric material sheet having inside and outside walls;

a first array of thin strips of dielectric material supported edgewise on one wall of the sheet, with the strips being spaced from each other and disposed parallel to each other, and with each strip being normal to the one wall, for providing anisotropy favoring parallel polarization components of incident radiation; and a second array of thin strips of dielectric material supported edgewise on the other wall of the sheet with the supported edges of the strips being spaced from one another and disposed perpendicular to the supported edges of the strips in the first array, and with all of the strips being tilted from the other wall at an acute angle in a common direction for providing anisotropy favoring perpendicular polarization components of incident radiation.

12. A radome according to claim 11, wherein each of the strips of the second array is tilted from the other wall at an angle of approximately 45 degrees.

* * * * *